US010648655B2

(12) United States Patent
Dorn et al.

(10) Patent No.: US 10,648,655 B2
(45) Date of Patent: May 12, 2020

(54) LIGHT MODULE FOR A VEHICLE WITH A HEAT SINK WITH VOID HOUSING A DRIVING DEVICE ARRANGED ON AN ELECTRONIC SUPPORT

(71) Applicant: Valeo Vision, Bobigny (FR)

(72) Inventors: David Dorn, Bobigny (FR); Eric Donnen, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/213,375

(22) Filed: Dec. 7, 2018

(65) Prior Publication Data

US 2019/0178484 A1 Jun. 13, 2019

(30) Foreign Application Priority Data

Dec. 7, 2017 (FR) ..... 17 61768

(51) Int. Cl.

| | |
|---|---|
| ***F21V 29/70*** | (2015.01) |
| ***F21S 45/47*** | (2018.01) |
| ***F21V 29/89*** | (2015.01) |
| ***F21V 23/00*** | (2015.01) |
| *F21Y 115/10* | (2016.01) |

(52) U.S. Cl.

CPC ..... *F21V 29/70* (2015.01); *F21S 45/47* (2018.01); *F21V 23/001* (2013.01); *F21V 23/004* (2013.01); *F21V 29/89* (2015.01); *F21Y 2115/10* (2016.08)

(58) Field of Classification Search

CPC ..... F21S 41/141; F21S 45/47; F21V 28/70; F21V 23/004

See application file for complete search history.

(56) References Cited

U.S. PATENT DOCUMENTS

| | | | | |
|---|---|---|---|---|
| 10,222,023 | B2 * | 3/2019 | Mornet | F21V 23/06 |
| 2016/0298818 | A1 * | 10/2016 | Duarte | H05K 1/0203 |
| 2017/0299143 | A1 | 10/2017 | Mornet | |
| 2017/0343180 | A1 | 11/2017 | Ishiyama et al. | |
| 2018/0112844 | A1 * | 4/2018 | Bowles | F21S 41/39 |

FOREIGN PATENT DOCUMENTS

| | | |
|---|---|---|
| DE | 20 2010 002 406 U1 | 6/2010 |
| EP | 1 923 626 A1 | 5/2008 |
| EP | 3 249 290 A1 | 11/2017 |
| FR | 3 026 467 A1 | 4/2016 |

OTHER PUBLICATIONS

French Preliminary Search Report dated Jul. 24, 2018 in French Application 17 61768 filed on Dec. 7, 2017 (with English Translation of Categories of Cited Documents).

* cited by examiner

*Primary Examiner* — Robert J May

(74) *Attorney, Agent, or Firm* — Oblon, McClelland, Maier & Neustadt, L.L.P.

(57) ABSTRACT

The invention relates to a light module (1) for a motor vehicle comprising:

a light source (10);

an electronic support (11);

a driver device (13) driving the electrical power supply of said one light source (10) arranged on said electronic support (11);

a heatsink (12) comprising an obviously (121) in which said driver device (13) is housed, characterized in that said light source (10) is fixed onto said heatsink (12).

20 Claims, 5 Drawing Sheets

LIGHT MODULE FOR A VEHICLE WITH A HEAT SINK WITH VOID HOUSING A DRIVING DEVICE ARRANGED ON AN ELECTRONIC SUPPORT

TECHNICAL FIELD OF THE INVENTION

The present invention relates to a light module for a motor vehicle.

The invention is applicable in particular but in a nonlimiting manner to the field of light devices for motor vehicles.

TECHNOLOGICAL BACKGROUND OF THE INVENTION

The prior art document EP 2360424 B1 describes a light module for a motor vehicle comprising:

- a light source;
- a driver device driving the electrical power supply of said light source arranged on an electronic support;
- a heatsink comprising an obviously in which said driver device is housed. The light source and the driver device are arranged on an electronic support, also called plate, and more particularly on opposite faces of said electronic support. They are thus arranged one facing the other and on either side of said electronic support.

One drawback with this state prior art is that the heat given off by the light source can thermally impact the driver device. This can ultimately disrupt the operation of said driver device. Likewise, the heat given off by the driver device can also thermally impact the light source.

In this context, the present invention aims to resolve the abovementioned drawback.

GENERAL DESCRIPTION OF THE INVENTION

To this end, the invention proposes a light module for a motor vehicle comprising:

- a light source;
- an electronic support;
- a driver device driving the electrical power supply of said one light source arranged on said electronic support;
- a heatsink comprising an obviously in which said driver device is housed, characterized in that said light source is fixed onto said heatsink.

Thus, as will be seen in detail hereinbelow, the light source which is directly fixed onto the heatsink and no longer directly onto the electronic support is thus remote from the driver device which is, for its part, fixed onto the electronic support and housed in an obviously of the heatsink provided for this purpose. The heat dissipation of the light source of the light module is thus improved because the thermal interactions between said light source and the driver device driving the electrical power supply are limited.

According to nonlimiting embodiments, the light module can also comprise one or more additional features out of the following:

According to a nonlimiting embodiment, said obviously is produced on a face of said heatsink onto which said light source is fixed.

According to a nonlimiting embodiment, said obviously is produced by punching.

According to a nonlimiting embodiment, said electronic support is a printed circuit board assembly or a flexible printed circuit.

According to a nonlimiting embodiment, said light source is connected to said electronic support via aluminium connecting wires.

According to a nonlimiting embodiment, said heatsink is made of sheet aluminium.

According to a nonlimiting embodiment, said light source is a semiconductor light source.

According to a nonlimiting embodiment, said semiconductor light source forms part of a light-emitting diode.

Also proposed is a light device for a motor vehicle comprising:

- a light module according to any one of the preceding features;
- an optical module adapted to cooperate with light rays emitted by said light source of said light module.

According to a nonlimiting embodiment, said light device is a headlight and/or an indicator light and/or a rear light or interior lighting.

According to a nonlimiting embodiment, said optical module is a reflector and/or a lens and/or a light guide.

BRIEF DESCRIPTION OF THE FIGURES

The invention and its various applications will be better understood on reading the following description and on studying the accompanying figures.

DESCRIPTION OF EMBODIMENTS OF THE INVENTION

The elements that are identical, by structure or by function, and that appear in various figures retain, unless stipulated otherwise, the same references.

The light module 1 for a motor vehicle according to the invention is described with reference to FIGS. 1 to 10.

Motor vehicle should be understood to mean any type of motorized vehicle.

Said light module 1 for a motor vehicle forms part of a light device 100.

In a nonlimiting embodiment, the light device 100 is a lighting and/or signalling device for a motor vehicle.

In nonlimiting examples, the light device 100 is:

a headlight; and/or an indicator light; and/or a fog light; and/or a rear light; or an interior lighting device.

Figure 1:
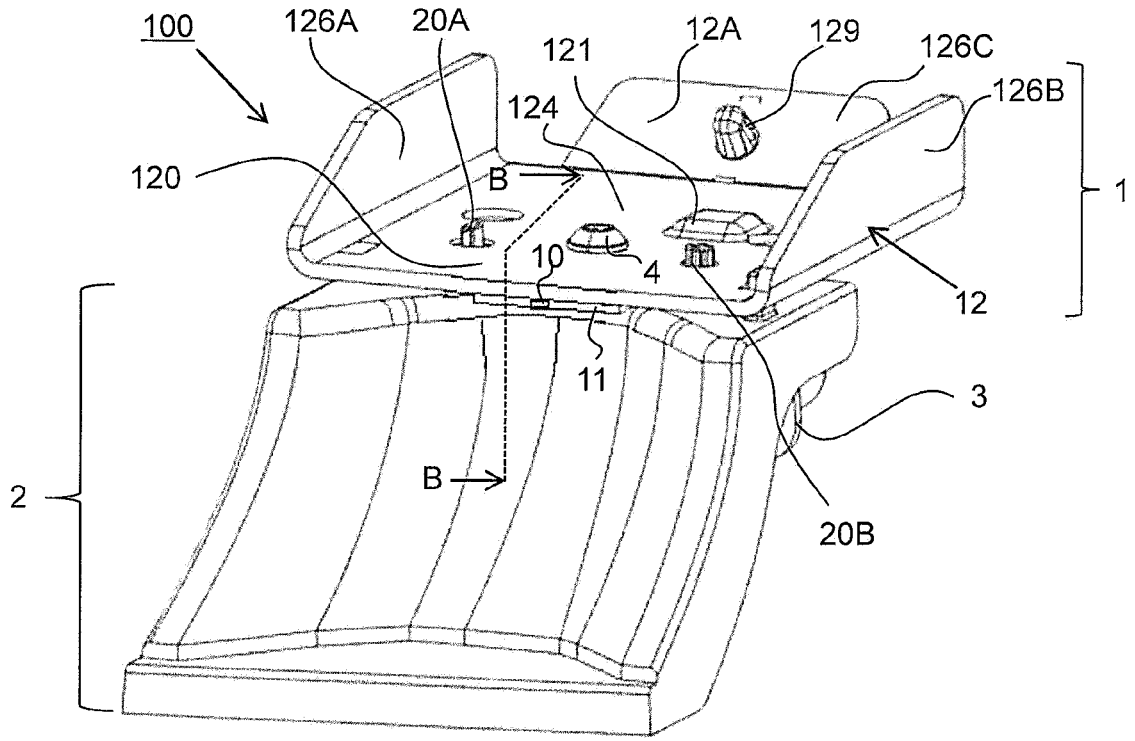
FIG. 1 represents a perspective view of a light device comprising a light module, according to a nonlimiting embodiment of the invention.

As illustrated in FIG. 1, in a nonlimiting embodiment, the light device 100 comprises:

at least one light module 1;

at least one optical module 2;

at least one anchoring module 3 for anchoring the light module 1 and the optical module 2 with the rest of the vehicle.

In a nonlimiting embodiment, the optical module 2 comprises a reflector and/or a lens and/or a light guide.

In a nonlimiting embodiment, the light device 100 comprises a plurality of light modules 1. In a nonlimiting example illustrated in FIG. 4, the light device 100 comprises three light modules 1A, 1B, 10 associated respectively with three optical modules 2A, 2B, 2C and with three anchoring modules 3A, 3B, 3C. The anchoring modules 3A, 3B, 30 are attached to one and the same frame 101.

Figure 5:
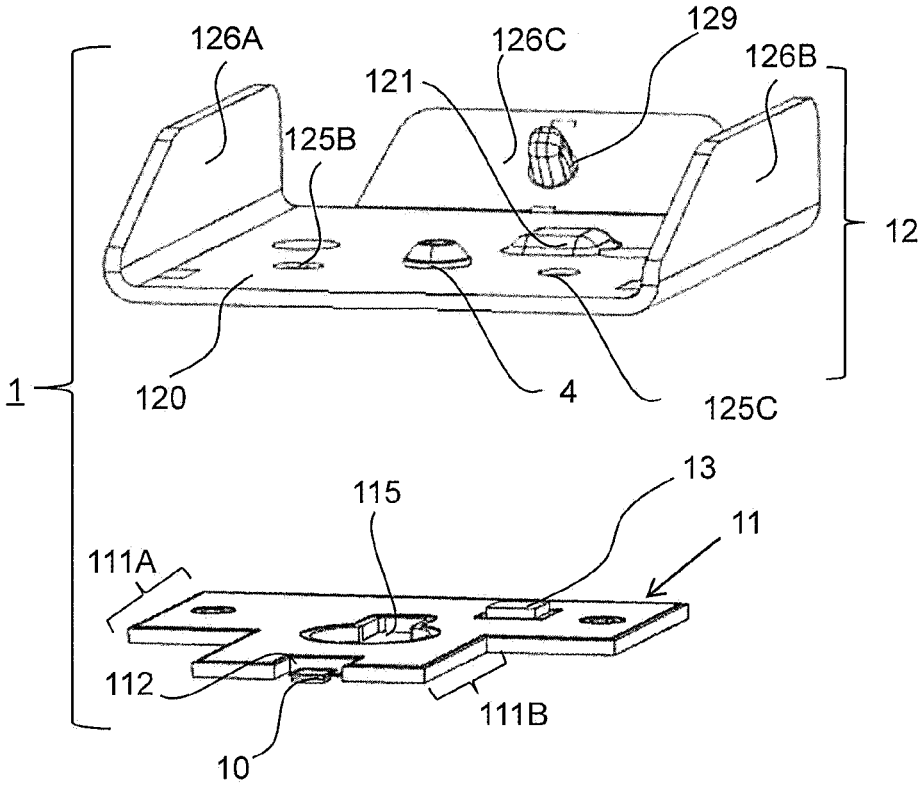
FIG. 5 represents a view from below of the heatsink of the light module of FIG. 4, according to a nonlimiting embodiment.

As illustrated in FIG. 5 for example, the light module 1 comprises:

a light source 10;

an electronic support 11;

a driver device 13 driving the electrical power supply of said light source 10 arranged on said electronic support 11;

a heatsink 12.

The driver device 13 driving the electrical power supply of said light source 10 will also be called driver device 13 hereinafter in the description.

The elements of the light module 1 are described in detail hereinbelow.

Light Source 10

The light source 10 is illustrated in FIGS. 3, and 5 to 10.

Figure 3:
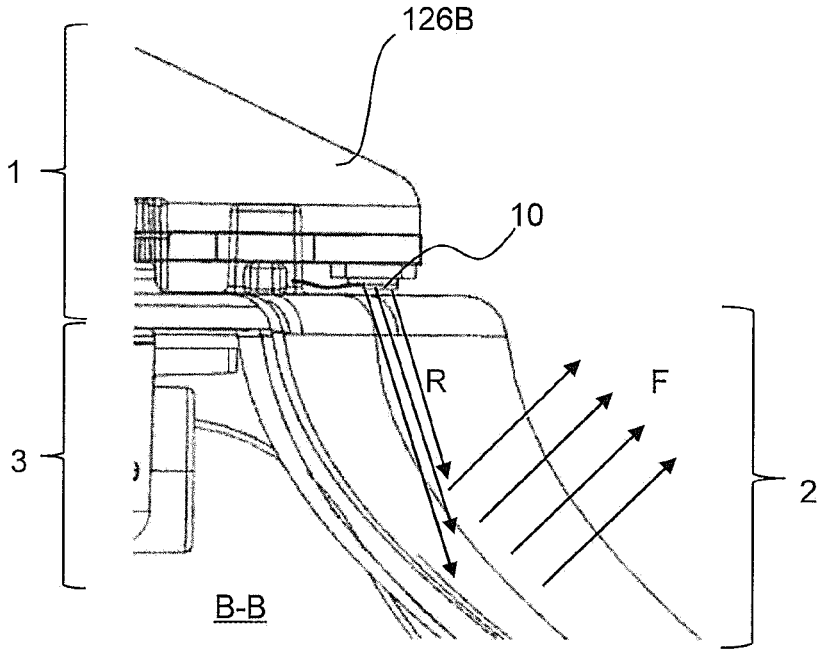
FIG. 3 represents an enlarged view of a cross section B-B of the light device of FIG. 1.
Figure 4:
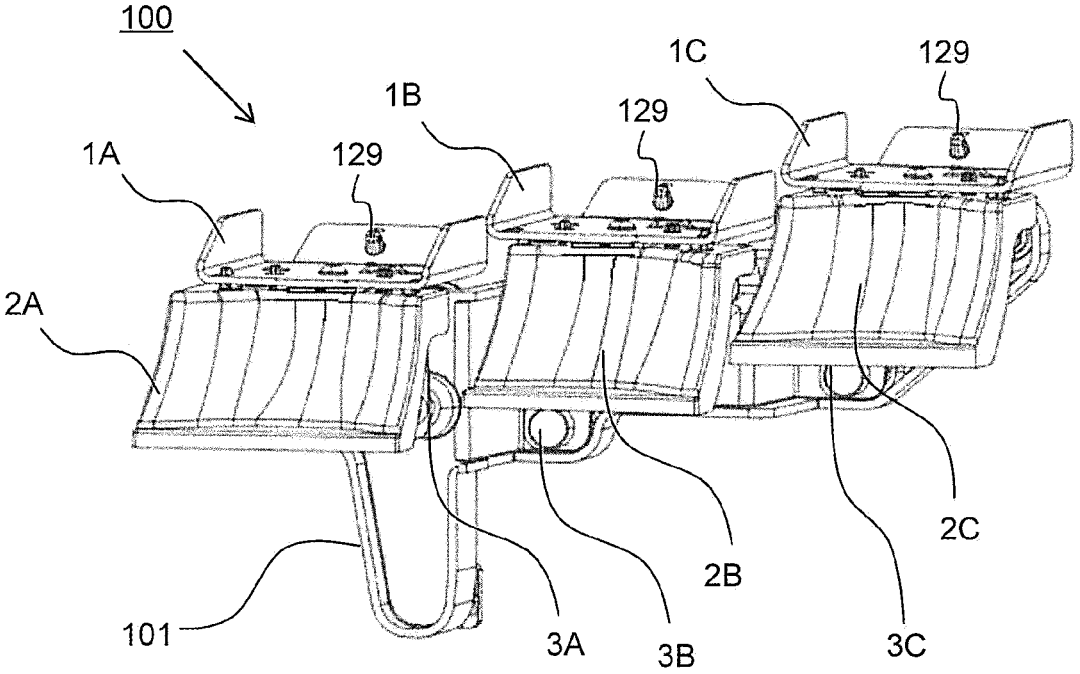
FIG. 4 represents an exploded perspective view of the light module of the light device of FIG. 1, said light module comprising a light source, an electronic support, a driver device and a heatsink, according to a nonlimiting embodiment.

As illustrated in FIG. 3, the light source 10 is adapted to emit light rays R. These light rays R cooperate with the optical module 2 of the light device 100 so as to form a light beam F.

In a nonlimiting embodiment, the light source 10 is a semiconductor light source.

In a nonlimiting embodiment, the semiconductor light source 10 forms part of a light-emitting diode.

Light-emitting diode should be understood to mean any type of light-emitting diode, whether they be, in nonlimiting examples, LEDs (Light-Emitting Diodes), an OLED (Organic LED) or an AMOLED (Active-Matrix-Organic LED), or even an FOLED (Flexible OLED).

The light source 10 is fixed onto the heatsink 12. It is thus arranged at a distance from the driver device 13. In fact, whereas the latter is arranged on the electronic support 11, the light source 10, for its part, is not arranged on said electronic support 11. That makes it possible to distance them from one another. The driver device 13 is thus less impacted thermally by the heat given off by the light source 10, and reciprocally, the light source 10 is less impacted thermally by the heat given off by the driver device 13.

Figure 6:
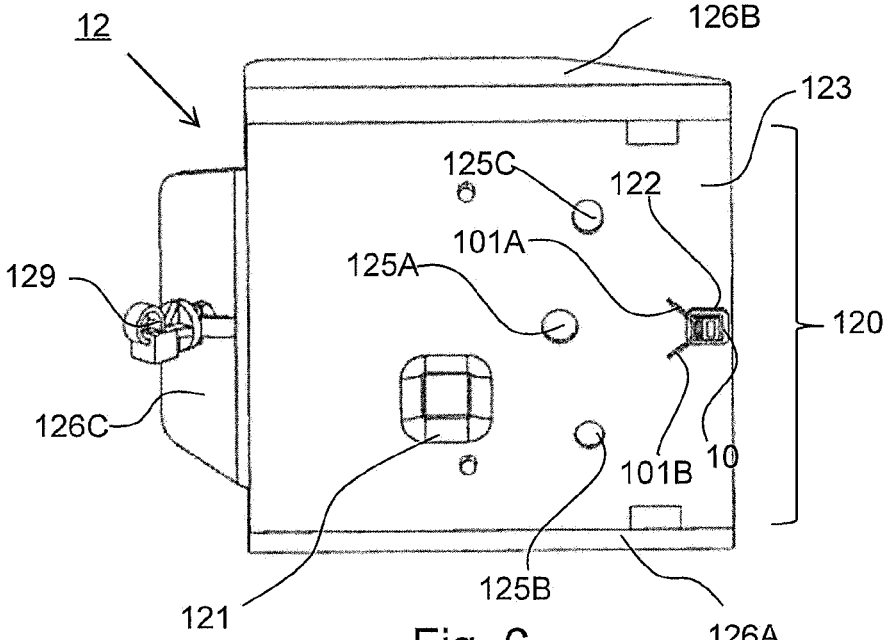
FIG. 6 represents a perspective view from below of the light module of FIG. 4, according to a nonlimiting embodiment.

Moreover, as illustrated in FIG. 6, in a nonlimiting embodiment, the light source 10 is fixed onto the face 123 of the heatsink 12 which comprises the void 121 in which the driver device 13 will be housed.

Electronic Support 11

The electronic support 11 is illustrated in FIGS. 5, and 7 to 10.

The electronic support 11 is adapted to accommodate and electrically link a set of electronic components to one another. In particular, it accommodates the driver device 13.

The electronic support 11, and in particular its electronic components including the driver device 13, generates heat in the operation thereof that has to be discharged out of the light module 1. The discharging of this heat is ensured by the heatsink 12 described later.

In a nonlimiting embodiment, the electronic support 10 is a printed circuit board, called PCBA board (Printed Circuit Board Assembly). This PCBA board comprises an assembly of one or more thin layers of copper separated by an insulating material. This assembly of layers gives the PCBA board a certain rigidity.

In a nonlimiting embodiment, the electronic support 10 is a flexible board, called "flex PCB" or "flexible printed circuit". This flexible printed circuit comprises a high performance plastic substrate, such as polyimide or a polyetherketone (PEEK) film. By virtue of the flexibility of the electronic support 11, it is possible to more easily position this electronic support 11 in the light module 1.

The electronic support 11 comprises:

a connector 114;

an opening 115;

electrical connection tracks (not illustrated) linking said electronic components to one another.

Figure 2:
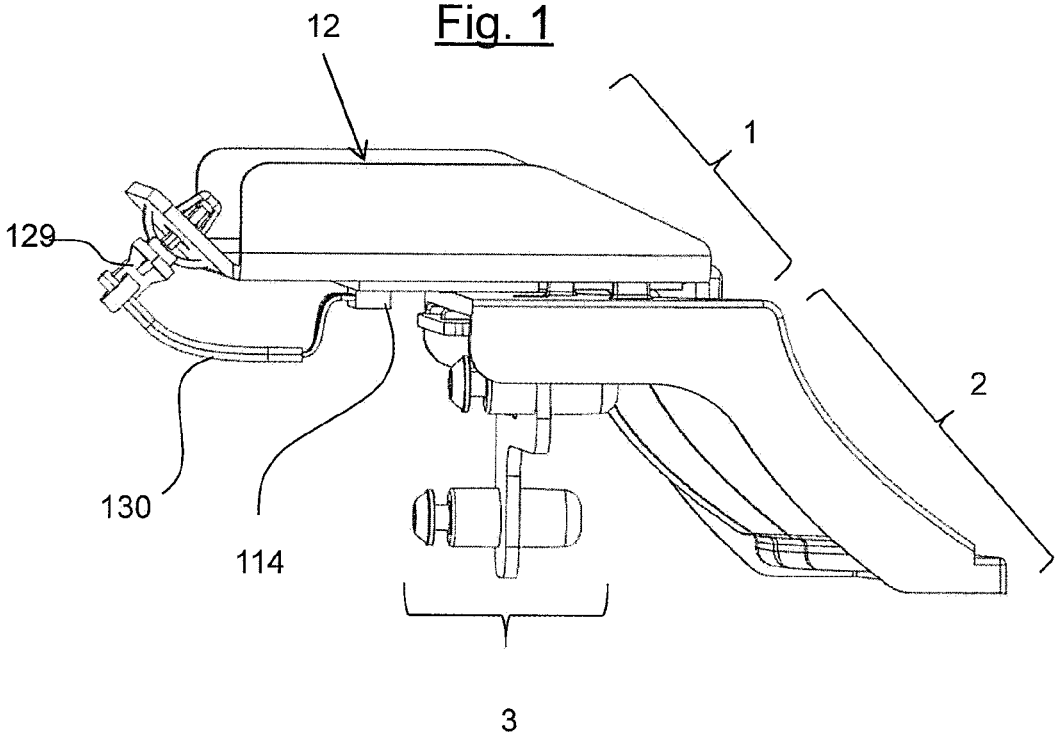
FIG. 2 represents a perspective side view of the light device of FIG. 1, according to a nonlimiting embodiment.
Figure 7:
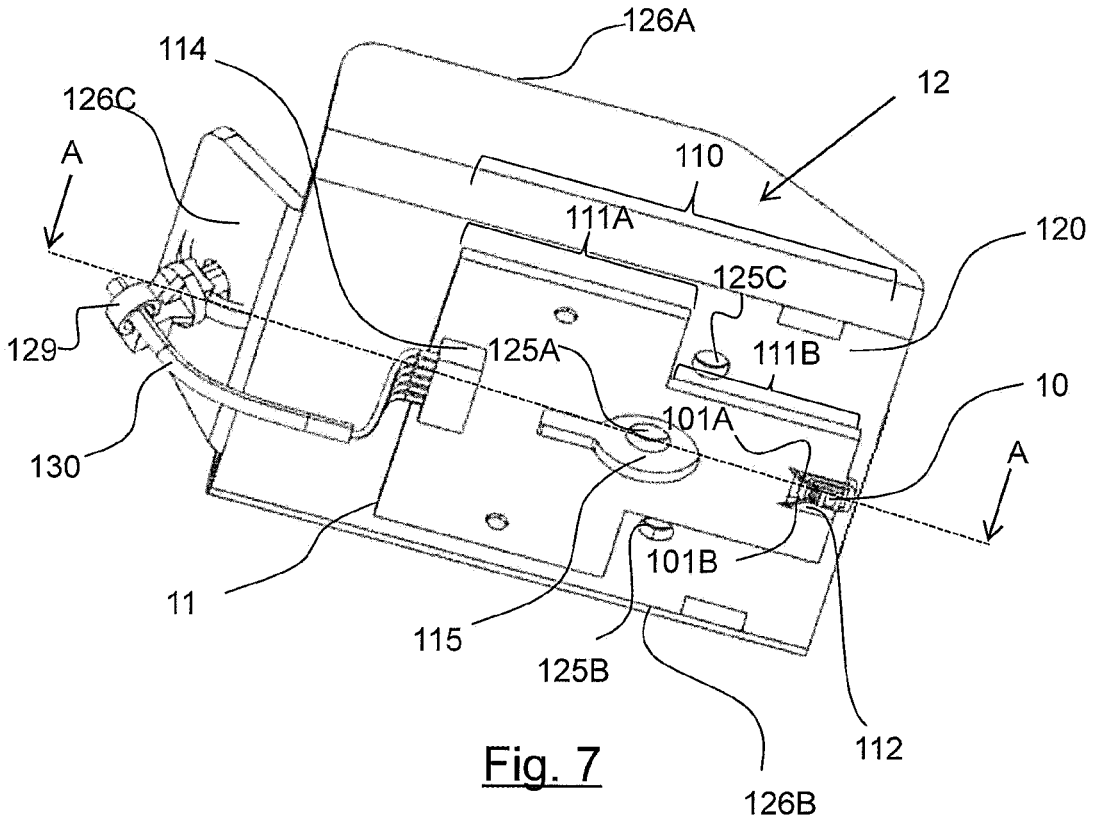
FIG. 7 represents a cross-sectional view along the axis A-A of the light module of FIG. 6, according to a nonlimiting embodiment.
Figure 8:
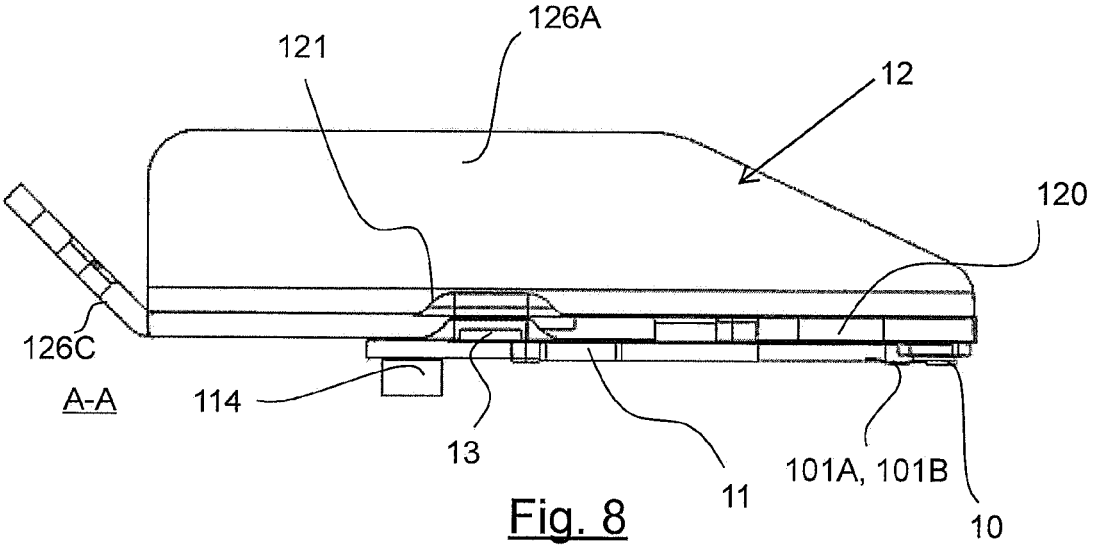
FIG. 8 represents a top view of the electronic support of the light module of FIG. 4, according to a nonlimiting embodiment.

The connector 114 is illustrated in FIGS. 2, 7 and 8. It is adapted to connect the electrical power supply loom 130 to the electronic support 11.

The opening 115 is illustrated in FIGS. 5, 7, 9 and 10. The opening 115 is adapted to fix the light module 1 onto the optical module 2. This opening 115 has a form adapted to receive a fixing screw 4 of the light module 1 and block said fixing screw 4. The head of the fixing screw is thus inserted into said opening 115 and performs a translation such that the head rests subsequently on the face 124 of the heatsink 12 as illustrated in FIG. 1.

Figure 9:
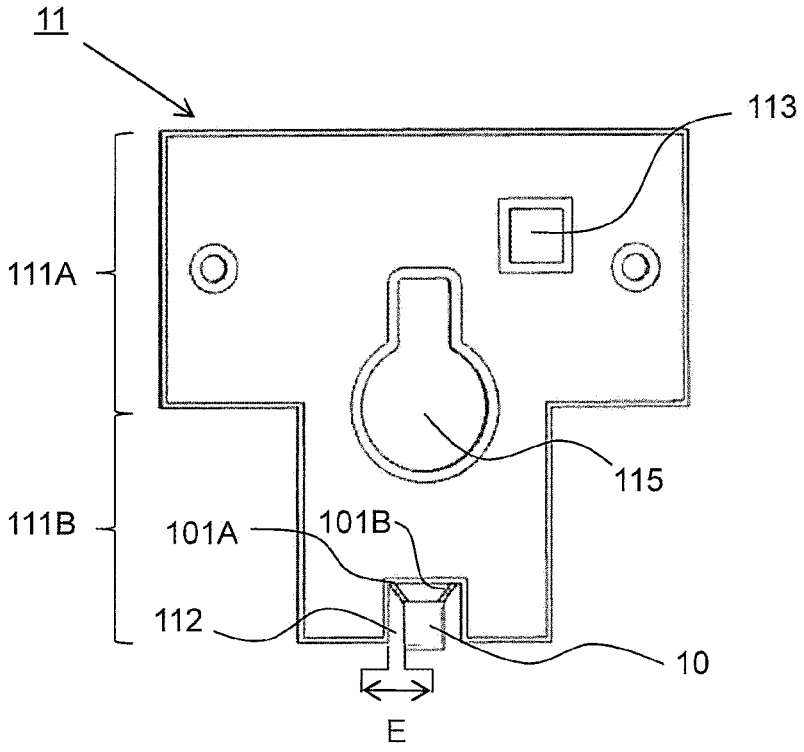
FIG. 9 represents a perspective view of the electronic support of the light module of FIG. 4 mounted on an optical module of the light device of FIG. 1, according to a nonlimiting embodiment.

As illustrated in FIG. 9, in a nonlimiting embodiment, the electronic support 11 comprises a first part 111A and a second part 111B which extends the first part 111A such that the electronic support 11 is substantially T shaped. The T shape makes it possible to allow the passage of the posts 20A and 20B (illustrated in FIG. 1) belonging to the optical module 2 on either side of said T shape, said posts 20A and 20B being adapted to be inserted into orifices 125A and 125B of the heatsink 12 provided for this purpose and illustrated in FIG. 7.

As illustrated in FIG. 5 or 9, the electronic support 10 accommodates the driver device 13. In particular, the latter is positioned on the first part 111A, at a distance from the light source 10.

At one end of this T shape, in a nonlimiting embodiment, the electronic support 11 comprises a notch 112 illustrated in FIG. 9 for example. This notch 112 makes it possible to have different positions of the light source 10 according to an axis of rotation at right angles to the plane of said light source 10 and do so without having to modify the design of the electronic support 11. Connection points (not illustrated) can thus be distributed all around the notch 112 on the electronic support 11 to connect the connecting wires 101A, 101B. This notch 112 is provided in the second part 111B. The notch 112 is adapted to receive and bracket the light source 10. The light source 10 is thus arranged in the extension of the electronic support 11, namely in the plane of said electronic support 11.

In a nonlimiting embodiment, the dimensions of the notch 112 are greater than the dimensions of the light source 10 so that there is a gap E (illustrated in FIG. 9) between the light source 10 and the electronic support 11.

Since the light source 10 is not fixed onto the electronic support 11, but directly onto the heatsink 12, that improves the thermal dissipation of the heat given off by said light source 10.

In a nonlimiting embodiment, the light source 10 is connected electrically to the electronic support 11 via connecting wires 101A, 101B illustrated in FIG. 9. In a nonlimiting variant embodiment, these connecting wires 101A, 101B are made of aluminium. As illustrated in FIGS. 6 to 9, two connecting wires 101A, 101B are used. One of said connecting wires is linked to the positive pole of the electrical power supply of the electronic support 11 and the other connecting wire is linked to the negative pole of the electrical power supply.

Thus, the light source 10 is linked electrically to the driver device 13 via the electronic support 10.

Driver Device 13

Figure 10:
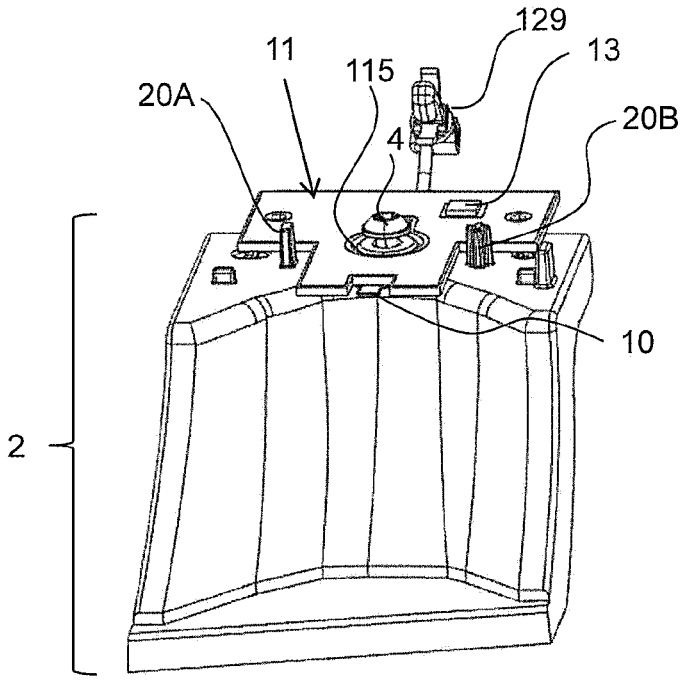
FIG. 10 represents a perspective view of a light device comprising three light modules of FIGS. 1 to 9, according to a nonlimiting embodiment.

The driver device 13 is illustrated in FIGS. 5, 8 and 10.

It is adapted to drive the electrical power supply of the light source 10.

In the embodiment of these figures, the driver device 13 is arranged directly on the electronic support 11. That makes it possible to simplify the management of the connections of the driver device 13 by comparison to an embodiment in which the driver device 13 is remote from the electronic support 10. In fact, in such an embodiment where the driver device 13 would be remote, the number of connections necessary for connecting said driver device 13 would be greater.

In a nonlimiting embodiment, the driver device 13 is linked by three connecting tracks (not illustrated in the figures) on the electronic support 10:

- a first connecting track links the driver device 13 to the positive pole of the electrical power supply of the electronic support;
- a second connecting track links the driver device 13 to the negative pole of the electrical power supply of the electronic support;
- a third connecting track links the driver device 13 to the rest of the vehicle, for the transmission of information such as vehicle diagnostic information.

In a nonlimiting embodiment, the driver device 13 is linked to an electronic temperature management component (not illustrated) arranged on the electronic support 11.

It will be noted that, in the case of a remote driver device 13, at least 7 connecting wires would be needed (if temperature management is included), namely two power supply wires, a ground wire, two temperature management wires and two diagnostic wires.

In a nonlimiting embodiment, the driver device 13 is linked to a resistor (not illustrated) arranged on the electronic support 11. This resistor is associated with the light source 10. The driver device 13 is then adapted to determine the characteristics of the light source 10, such as the type of light source or its power, according to this resistor and data incorporated in the memory of the driver device 13.

In a nonlimiting embodiment, the driver device 13 comprises a DC/DC converter. A DC/DC converter comprises a plurality of electronic components such as, in a nonlimiting example, at least one MOSFET transistor.

The driver device 13 is housed in a void 121 of the heatsink 12. It thus faces a face 123 of said heatsink 12 on which the light source 10 is located.

In a nonlimiting embodiment, the driver device 13 is not in contact with the surface of the void 121. There is thus a gap which facilitates assembly. In another nonlimiting embodiment, the driver device 13 is in contact with all or part of the surface of the void 121. That increases the thermal dissipation.

Heatsink 12

The heatsink 12 is illustrated in FIGS. 1 to 8.

It is adapted to dissipate the heat given off by the electronic support 11, in particular by its electronic components.

In a first nonlimiting embodiment, the heatsink 12 is made of sheet aluminium.

In a second nonlimiting embodiment, the heatsink 12 is obtained by punching a sheet of aluminium, that is to say by striking and folding this sheet of aluminium. This production method makes it possible to obtain a more precise heatsink part 12 and without needing any mechanical machining rework. The costs of production of the heatsink 12 are thus reduced.

In a third nonlimiting embodiment, the heatsink 12 is obtained by injection of aluminium into a mould. In this case, mechanical machining rework is involved.

As illustrated in FIG. 5, the heatsink 12 comprises:

a baseplate 120;

a first lateral face 126A and a second lateral face 126B.

These elements are described in detail hereinbelow.

Baseplate 120

In a nonlimiting embodiment, the baseplate 120 is substantially square and is adapted to be arranged on the electronic support 11 so as to cover it.

More particularly, the baseplate 120 is adapted to be pressed onto said electronic support 11.

The baseplate 120 comprises two faces 123 and 124 opposite one another.

The face 123 is the face of the heatsink 12 which comes into contact with the electronic support 11 as illustrated in FIG. 8.

As illustrated in FIG. 6, the baseplate 120 comprises:

a void 121;

a fixing zone 122 for the light source 10;

a first orifice 125A;

a second orifice 125B and a third orifice 125C.

These elements are described in detail hereinbelow.

Void 121

The void 121 is produced on the face 123 of the baseplate 120, namely on the face onto which said light source 10 is fixed. That makes it possible to make the light module 1 more compact in a given direction, here axially, contrary to the prior art in which the light source is arranged on the electronic support on the face opposite to that where the driver device is located.

The void 121 is adapted to accommodate the driver device 13 of the electronic support 11. When the heatsink 12 is arranged on the electronic support 11 as illustrated in FIG. 8, the void 121 covers the driver device 13 and encapsulates it such that the latter is totally surrounded by said void 121. Said void 121 thus protects the driver device 13 from the electromagnetic waves that can originate from other members of the motor vehicle (such as the radio, the navigation system, etc., in nonlimiting examples). This phenomenon that is well known to the person skilled in the art is called problem of electromagnetic accounting (EMC). Furthermore, the void 121 protects the other members of the motor vehicle from the electromagnetic waves generated by said driver device 13.

Moreover, the fact that said void 121 surrounds the driver device 12 makes it possible to obtain a very effective thermal dissipation of said driver device 12 by said heatsink 12. Consequently, the size of the heatsink 12 can thus be reduced, and consequently its weight.

In a first nonlimiting embodiment, the void 121 is produced by punching. This is a simple way of producing said void 121.

In a second nonlimiting embodiment, the void 121 is moulded by a protuberance of a mould.

The void 121 thus makes it possible to reduce the production costs of the light module 1 since it makes it possible to no longer use an additional part for the EMC problem such as an added EMC protection cover for the driver device 13. Furthermore, it also improves the compactness of the light module 1 in a given direction, here axially, by virtue of the elimination of the EMC protection cover.

Fixing zone 122

The fixing zone 122 is adapted to receive the light source 10.

This fixing zone 122 is arranged on the same face 123 as that of the void 121 as illustrated in FIG. 6. The obviously 121 is therefore produced on the face 123 of the heatsink 12 onto which the light source 10 is fixed. Thus, the connection between the light source 10 and the electronic support 11 for linking said light source 10 to said driver device 13 is simplified. There is in fact no need to pass connecting wires through the baseplate 120 of the heatsink 12 to connect said light source 10 to said electronic support 11 as would be the case if the light source 10 were located on the opposite face 124. In a nonlimiting embodiment, the light source 10 is fixed by gluing.

Thus, the fixing of the light source 10 directly onto the heatsink 12 instead of the electronic support 11 makes it possible to obtain a better heat dissipation from said light source 10. It will be noted that this fixing onto the heatsink 12 is called "submount".

This fixing directly onto the heatsink 12 makes it possible to simply access said light source 10, for example for maintenance operations, when the heatsink 12 is removed from the light module 1. It will be noted that when said heatsink 12 covers the electronic support 11, the light source 10 is inserted into the notch 112 of said electronic support 11 described previously.

Openings 125A, 125B, 125C

As illustrated in FIG. 7, the first orifice 125A is facing the opening 115 of the electronic support 11.

It is thus adapted to allow the passage of the fixing screw 4, in particular the body thereof.

The fixing screw 4 comprises a head and a threaded body. As illustrated in FIG. 1, the head of the fixing screw 4 bears on the baseplate 120 of the heatsink 12 on the side of the face 124 and the threaded body is housed in the optical module 2. The light module 1 is thus fixed onto the optical module 2 by the fixing screw 4.

As illustrated in FIG. 10, the second orifice 125B and the third orifice 125C are adapted to receive posts 20A and 20B belonging to the optical module 2. The posts 20A, 20B are adapted to guide the baseplate 120 of the heatsink 12 with respect to the optical module 2 when the light module 1 is put in place on said optical module 2.

Lateral Faces 126A, 126B, 126C

As illustrated in FIGS. 1, 5 and 7, the first lateral face 126A and the second lateral face 126B are arranged on either side of the baseplate 120 and facing one another.

The first lateral face 126A and the second lateral face 126B extend substantially at right angles to the baseplate 120 outward from the light module 1. The heat exchange surface of the heatsink 12 is thus increased which improves the thermal cooling of the light module 1.

In a nonlimiting embodiment that is illustrated, the outer surfaces of the first lateral face 126A and of the second lateral face 126B are planar.

In a nonlimiting embodiment illustrated in FIGS. 1, 5 and 7, the heatsink 12 also comprises a third lateral face 126C. The third lateral face 126C extends from the baseplate 120 obliquely outward from the light module 1. The third lateral face 126C is arranged between the first lateral face 126A and the second lateral face 126B. The third lateral face 126C makes it possible to secure the electrical power supply loom 130 so that the latter does not move when the motor vehicle is in motion. To this end, the third lateral face 126C comprises an orifice for the passage of a head of an attachment point 129 described hereinbelow.

Attachment Point 129

In a nonlimiting embodiment, the heatsink 12 also comprises an attachment point 129 for the electrical power supply loom 130. The attachment point 129 is illustrated in FIGS. 2, 5, 7 and 10. In a nonlimiting embodiment, the attachment point 129 comprises a hook adapted to secure the electrical power supply loom 130 in position and as close as possible to the heatsink 12.

Obviously, the description of the invention is not limited to the embodiments described above.

Thus, in a nonlimiting embodiment, the light source 10 is connected electrically to the electronic support 11 via ribbon cables or bus bars.

Thus, in a nonlimiting embodiment, the light module 1 comprises a plurality of light sources 10.

Thus, the invention described offers in particular the following advantages:

- the distancing of the light source 10 and the driver device 13 from one another makes it possible to reduce the thermal interactions between the driver device 13 and the light source 10;
- the placing of the light source 10 directly on the heatsink 12 allows for a better thermal dissipation of the heat generated by said light source 10;
- the reducing of the thermal interactions between the driver device 13 and the light source 10 and the better cooling of said light source 10 makes it possible to improve the thermal dissipation of the light module 1 overall;
- it makes it possible to increase the performance levels of the light source 10 since the heat that it generates is better dissipated;
- it makes it possible to limit the EMC emissions of the light module 1, and more particularly of the driver device 13;
- it makes it possible to optimize the production costs of the light module 1, in particular because the driver device 13 is incorporated in the electronic support 11 and not remotely sited from this electronic support 11, through the limiting of the number of parts compared to an added EMC protection cover;
- it makes it possible to obtain a light module 1 that is more compact because the driver device 13 is arranged on the side of the face 123 of the heatsink 12 onto which the light source 10 is fixed and not on the opposite face;

there is no need to have an additional EMC protection metal covering on the electronic support 11.

The invention claimed is:

1. A light module for a motor vehicle comprising:

a light source;

an electronic support;

a driver device driving an electrical power supply of the light source arranged on the electronic support; and a heatsink comprising a void in which the driver device is housed, wherein the light source is fixed onto the heatsink, and the void is adapted to accommodate the driver device, covering and containing the driver device, such that the driver device is totally surrounded by the void.

2. The light module according to claim 1, wherein the void is provided on a face of the heatsink onto which the light source is fixed.

3. The light module according to claim 2, wherein the void is provided by punching.

4. The light module according to claim 2, wherein the electronic support is a printed circuit board assembly (PCBA) or a flexible printed circuit.

5. The light module according to claim 2, wherein the light source is connected to the electronic support via aluminium connecting wires.

6. The light module according to claim 2, wherein the heatsink is made of sheet aluminium.

7. The light module according to claim 2, wherein the light source is a semiconductor light source.

8. A light device for a motor vehicle comprising:

a light module according to claim 2;

an optical module adapted to cooperate with light rays emitted by the light source of the light module.

9. The light module according to claim 1 wherein the void is provided by punching.

10. The light module according to claim 9, wherein the electronic support is a printed circuit board assembly (PCBA) or a flexible printed circuit.

11. The light module according to claim 9, wherein the light source is connected to the electronic support via aluminium connecting wires.

12. The light module according to claim 1, wherein the electronic support is a printed circuit board assembly (PCBA) or a flexible printed circuit.

13. The light module according to claim 1, wherein the light source is connected to the electronic support via aluminium connecting wires.

14. The light module according to claim 1, wherein the heatsink is made of sheet aluminium.

15. The light module according to claim 1, wherein the light source is a semiconductor light source.

16. The light module according to claim 15, wherein the semiconductor light source forms part of a light-emitting diode.

17. A light device for a motor vehicle comprising:

a light module according to claim 1; and an optical module adapted to cooperate with light rays emitted by the light source of the light module.

18. The light device according to claim 17, wherein the light device is a headlight and/or an indicator light and/or a rear light or interior lighting.

19. The light device according to claim 18, wherein the optical module is a reflector and/or a lens and/or a light guide.

20. The light device according to claim 17, wherein the optical module is a reflector and/or a lens and/or a light guide.

* * * * *